US008444843B2

(12) United States Patent
Elanany et al.

(10) Patent No.: US 8,444,843 B2
(45) Date of Patent: May 21, 2013

(54) ELECTROCATALYTIC DISSOCIATION OF WATER FOR HYDRODESULFURIZATION OF HYDROCARBON FEEDSTOCK

(75) Inventors: Mohamed Elanany, Ras Tamura (SA); Esam Z. Hamad, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 365 days.

(21) Appl. No.: 12/798,989

(22) Filed: Apr. 15, 2010

(65) Prior Publication Data

US 2011/0253557 A1 Oct. 20, 2011

(51) Int. Cl.
*C25B 1/00* (2006.01)
*C10G 32/02* (2006.01)
*C10G 45/26* (2006.01)

(52) U.S. Cl.
USPC ..... 205/352; 205/554; 205/696; 205/353; 208/208 R; 208/209

(58) Field of Classification Search ..... 205/554, 205/352, 353
See application file for complete search history.

(56) References Cited

U.S. PATENT DOCUMENTS 4,246,082 A 1/1981 Feuerman
4,547,273 A * 10/1985 Ayers ..... 205/440
4,670,113 A 6/1987 Lewis
4,954,229 A 9/1990 Kim et al.
5,004,526 A * 4/1991 Ramshaw ..... 205/353
5,458,752 A * 10/1995 Lizama et al. ..... 204/164
5,582,139 A 12/1996 Feuerman
5,711,770 A 1/1998 Malina
5,723,039 A 3/1998 Zosimov et al.
6,218,556 B1 4/2001 Pintauro
6,274,026 B1 8/2001 Schucker et al.
6,478,947 B2 11/2002 Nagasaku et al.
7,001,504 B2 2/2006 Schoonover
7,244,351 B2 7/2007 Báez et al.
2008/0099374 A1 5/2008 He et al.
2008/0251422 A1 10/2008 Baez et al.
2008/0257785 A1 10/2008 Varma et al.
2009/0159427 A1 6/2009 Greaney et al.
2009/0166261 A1 7/2009 Li et al.
2009/0173664 A1 7/2009 Choi et al.
2009/0178952 A1 7/2009 Choi et al.

* cited by examiner

*Primary Examiner* — Harry D Wilkins, III

(74) *Attorney, Agent, or Firm* — Abelman, Frayne & Schwab

(57) ABSTRACT

An electrocatalytic process to remove organic sulfur compounds from a mixture of water containing a miscible electrolyte and a hydrocarbon feedstock involving the application of a current of electricity to cause the dissociation of the water which produces hydrogen at a catalytic cathode which reduces the organic sulfur compounds in the hydrocarbon with the evolution of $H_2S$ which is separated and collected, and the separation and collection of the treated hydrocarbon.

12 Claims, 2 Drawing Sheets

ELECTROCATALYTIC DISSOCIATION OF WATER FOR HYDRODESULFURIZATION OF HYDROCARBON FEEDSTOCK

FIELD OF THE INVENTION

This invention relates to a method for the removal of sulfur from organic sulfur compounds present in oil feedstocks and, more particularly, it relates to an electrocatalytic method for effecting such removal.

BACKGROUND OF THE INVENTION

The majority of the energy consumed by society is produced from fossil fuels. In order to meet the continuing and expanding use of petroleum, it is necessary to upgrade the lower quality crude oils, which exhibit a progressive decrease in API gravity and a rise in sulfur content. However, it is equally necessary to remove sulfur from oil to meet the strict new environmental regulations which have been enacted.

The commercial hydrodesulfurization (HDS) process which is currently used to remove sulfur from petroleum employs Co—Mo/$Al_2O_3$ or Ni—Mo/$Al_2O_3$ catalysts. While HDS and its modified versions, e.g. modifying the catalyst activity or reactor configuration, etc. are highly efficient in removing thiols, sulfides, and disulfides, it is however, less effective in removing refractory sulfur present in aromatic sulfur compounds, e.g. dibenzothiophene, and their alkylated derivatives. In addition, the HDS process has high operating costs due to the high pressure and high temperature employed and the extensive use of hydrogen gas. Therefore, achieving a viable and economical desulfurization process is a major challenge to the oil industry. Furthermore, with the increase in oil prices, the development of new technologies and processes for desulfurization of heavy oil, at a lower cost, have taken on even greater importance.

In U.S. Pat. No. 6,274,026, Schucker et al. discloses a technology based on the polymerization of sulfur compounds in an electrochemical cell using ionic liquids as electrolytes. However, it is not efficient due to the difficulty in separating the polymerized compounds.

In U.S. Pat. No. 7,001,504, Schoonover discloses a method to extract organosulfur compounds from hydrocarbons using ionic liquids. Due to the high price and the difficulty to recycle these ionic liquids, commercialization of this method is a challenging task.

US Published Application No. 2008/0257785 to Varma et al. discloses a sorbent for the adsorption of aromatic sulfur compounds from liquid fuels. Such sorbents cannot, however, be used for heavy oil feeds like VR or crude oils.

U.S. Pat. No. 4,670,113 to Lewis, discloses electrochemical activation in gasification and a combined gasification liquification process due to the production of reactive atomic hydrogen from dissociated water. However, catalytic electrodes and the application to desulfurization are not disclosed.

U.S. Pat. No. 4,954,229 to Kim et al. discloses a bioelectrochemical process for removing sulfur compounds from fuels using hydrogen and bacterium to reduce sulfur compounds and produce hydrogen sulfide. However, the low conversion using anaerobic bacterium makes the deployment of this invention impractical.

The electrochemical generation of hydrogen is disclosed by Pintauro in U.S. Pat. No. 6,218,556 for hydrogenating unsaturated fatty acids, constituents of an edible or non-edible oils triglycerides using solid polymer electrolyte. However, there is no disclosure of using a solid polymer electrolyte for desulfurization due to the relatively high operating temperature and the fouling of the polymer which is encountered when using heavy oil feeds.

Baez et al. in U.S. Pat. No. 7,244,351 and US Published Application No. 2008/0251422 disclose the removal of sulfur from hydrocarbon feeds using two compartments separated by a metal membrane in a cell. Although promising results (~35% sulfur reduction) were obtained for a model sulfur compound (thiophene), only ~13% reduction was obtained for diesel oil. Furthermore, the process is not practical for processing heavier oil feedstocks due to membrane fouling and diffusion limitations.

Currently, water electrolysis for hydrogen production is more costly when compared to the large-scale chemical process which is based on the steam reforming of natural gas (methane). However, an appreciable increase in water electrolysis is expected in the future as natural gas resources diminish and the production of cheap electrical power in nuclear power plants increases. Also, photovoltaic devices can be used as an alternative green source of electrical energy.

SUMMARY OF THE INVENTION

In accordance with an embodiment of the present invention, an electrocatalytic process is provided for the removal of organic sulfur compounds which are present in petroleum feedstocks, such as diesel oil, crude oil, vacuum residue, etc. The process contemplates the mixing of a hydrocarbon stream with a stream of water containing at least one electrolyte which is only miscible with the water. The mixture of hydrocarbon and water with an electrolyte are admitted into a reactor or electrochemical cell having at least one pair of catalytically conductive electrodes (cathode and anode). The mixture is continuously stirred in the reactor or cell and, due to the miscibility limitations referred to above, an oil phase and an aqueous phase is formed.

A potentiostat is coupled to the electrodes to establish a potential voltage differential between the electrodes. As the electric current passes through the mixture, the water dissociates to produce reactive hydrogen in situ that reacts catalytically and instantaneously in the reactor with the sulfur compounds in the hydrocarbon phase at the surface of the electrode, to produce hydrogen sulfide and sulfur-free hydrocarbons. Since hydrogen is generated in situ directly on the surface of the catalytic electrode, the need for high operating temperatures, as is characteristic in typical hydrosulfurization processes is avoided, since the energy reaction barrier is lower.

The process not only results in the separation and recovery of the treated oil and the sulfide evolved, it also provides for the recycling of the water.

It is therefore, an object of the present invention to introduce an economical process for the electrocatalytic desulfurization of hydrocarbon feedstocks that results in the generation and reaction of atomic hydrogen at the surface of a catalytic electrode with the sulfur compounds in the hydrocarbon to produce $H_2S$ and treated oil.

It is another object of the invention is to separate and recover the treated hydrocarbon and the hydrogen sulfide and recycle the water.

The foregoing objects as well as other objects and advantages will become apparent from the following detailed description.

DETAILED DESCRIPTION OF THE INVENTION

Figure 1:
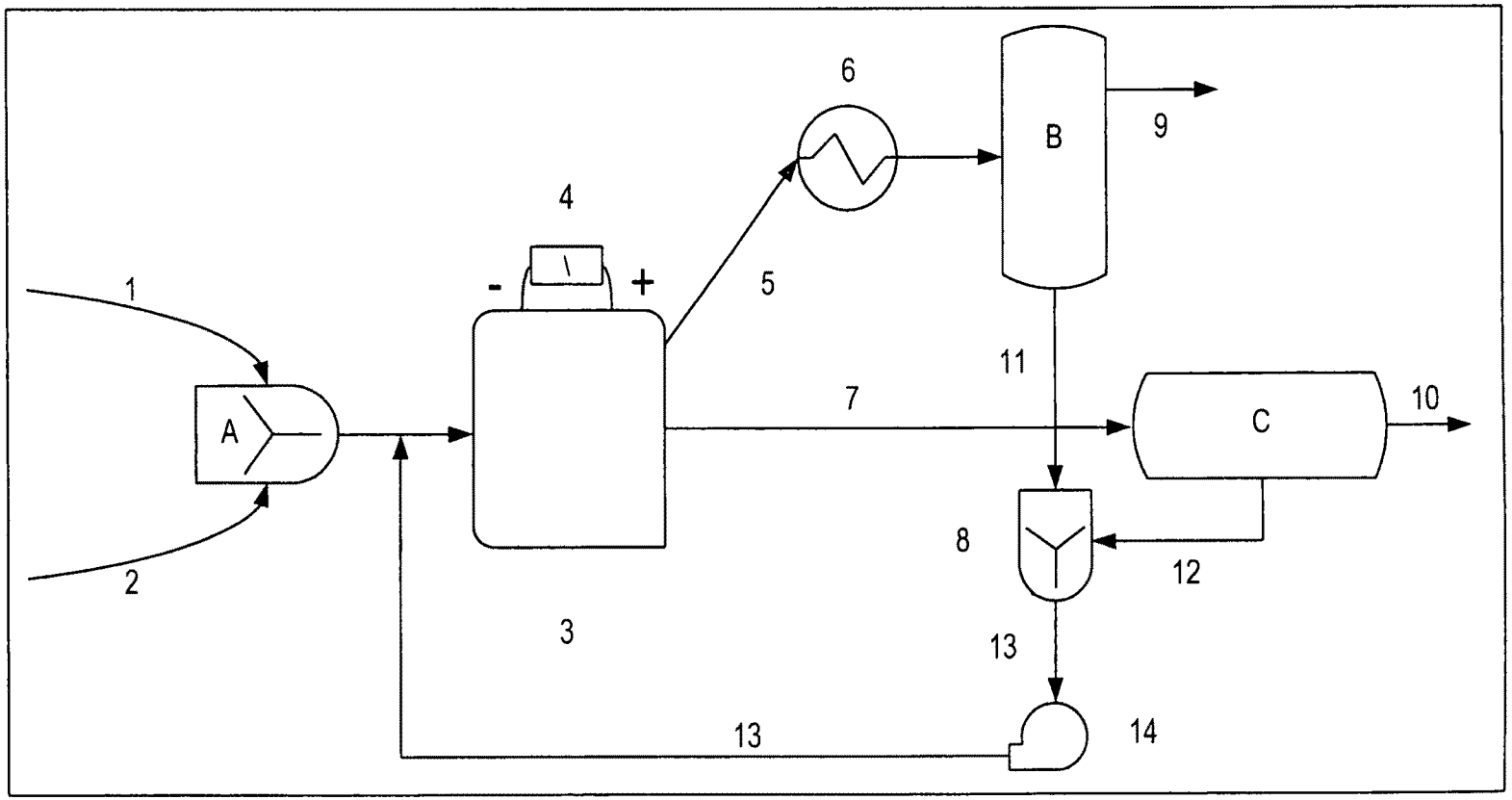
FIG. 1 is a schematic illustration of the electrocatalytic desulfurization process of the present invention.

The present invention broadly contemplates in a preferred embodiment a process for the electrocatalytic desulfurization of oil feedstocks and the benefits to be realized by such a process. The oil feedstocks can be naphtha, diesel, vacuum residue, crude oil or mixtures thereof that contain from about 0.2 to about 6 (W %) of sulfur. In the process of the present invention which is presented schematically in FIG. 1, a stream of water 1 is mixed with a hydrocarbon stream 2 through a mixing point A while stirring is maintained. At least one electrolyte is added to the water stream, such as an acid, a base, or a metal salt in a concentration range of about 0.001M to about 5 M with from about 0.1 to 2 M being preferred. Exemplary electrolytes are potassium hydroxide, sodium sulfate and magnesium sulfate, with sulfuric acid being preferred.

The resulting mixture, in which the water/oil ratio is in the range of about 0.01 to about 3.0, is admitted into an electrochemical reactor 3 with continuous stirring. Due to limitations in miscibility, a separate oil phase and a separate aqueous phase containing the electrolyte are observed to form.

The electrochemical reactor 3 is provided with at least two catalytically conductive electrodes, a cathode and an anode, which act as a catalyst for dissociation and hydrosulfurization. The electrodes can assume various shapes, such as wires, rods, a mesh or a porous structure. Using an appropriate current source, such as a potentiostat 4, a potential difference is applied between the electrodes in the range of about 0.1 to about 50 V, with about 0.2 V to about 10 V being preferred. The contents of the reactor 3 are heated to a temperature in the range of about 20° C. to about 400° C., with the preferred temperature range being from about 100° C. to about 280° C. The reaction preferably proceeds for a period of about 0.1 hours to about 25 hours or greater (space velocity of about 10 to about 0.04 $hr.^{-1}$).

The catalytic materials employed in the electrodes are important parameters in the process that affect the desulfurization time and the percentage conversion. The electrode materials are selected from the metals of Groups VIIIb, Ib and IIb of the Periodic Table, preferably from one or more of the following metals and mixtures thereof: Fe, Ru, Ni, Pd, Pt, Au, Cu, and Ag, as well as their conductive oxides, carbides, sulfides, hydrides, and nitrides, and metal/support.

The electrocatalytic desulfurization which takes place at the cathode can be expressed generally by the following equations:

$$H_2O \rightarrow \tfrac{1}{2}O_2 + 2H.$$

$$RS + 2H. \rightarrow H_2S + R \text{ (treated oil)},$$

where H. is the reactive hydrogen and RS represents the organic compounds containing sulfur in the oil feed.

Thus, the reactive hydrogen which is formed interacts with the sulfur-containing compounds in the oil phase at the surface of the cathode to generate $H_2S$. The presence of the reactive hydrogen species facilitates the desulfurization reaction on the surface of the catalytic cathode by lowering the activation energy barrier of the hydrodesulfurization reaction. To enhance the economics of the process, the source of the applied potential on the electrodes can be, for example, a nuclear plant, a photovoltaic cell, or solar cells.

After completion of the desulfurization, $H_2S$ with entrained water-vapor exits the reactor 3 via a stream 5 and enters a heat exchanger 6. Thereafter, it passes into a gas-liquid separator B, with the $H_2S$ being separated and passing via a stream 9 to a conventional sulfur recovery unit (SRU), not shown, and the water from the water vapor being separated and passing to a stream 11.

A stream 7 containing the treated petroleum feedstock and water passes into a liquid-liquid separator C. The treated petroleum stream 10, from which the water has been removed is recovered, and the stream of water 12 from separator C and the stream of water 11 from the gas-liquid separator B join together and are mixed at mixing point 8. A stream of water 13 is formed at the outlet of mixing point 8, which is then recycled by a pump 14 to the mixture of streams 1 and 2 which enter the reactor 3. Since a quantity of water is consumed in the reactor 3 through the electrocatalytic dissociation, the recycling of the water makes the process more efficient.

The following examples demonstrate the process of the present invention, but are not intended to limit the invention in any manner beyond what is recited in the claims.

Example 1

A hydrocarbon feedstock with the following specifications (gravity, 30.9 API at 60° F. sulfur x-ray w % 1.749) was used. A 1:1 oil-to-water ratio was employed with the addition of sulfuric acid 0.2 M as the electrolyte. The oven employed was preheated to the temperatures indicated below in Table 1. Before starting the current and voltage measurements, the 100 ml reactor to be employed was kept in the oven for two hours to equilibrate with the designated temperature. After applying the constant potential difference of 1.4 V between the electrodes for the time specified in Table 1 below, oil and water phases were separated using a centrifuge and separating funnel. Sulfur concentration in the oil separating phase was measured using XRF analyzer (Twin-X, Oxford instruments). The desulfurization % was then calculated from the reduction in sulfur concentration as compared to the initial concentration.

Figure 2:
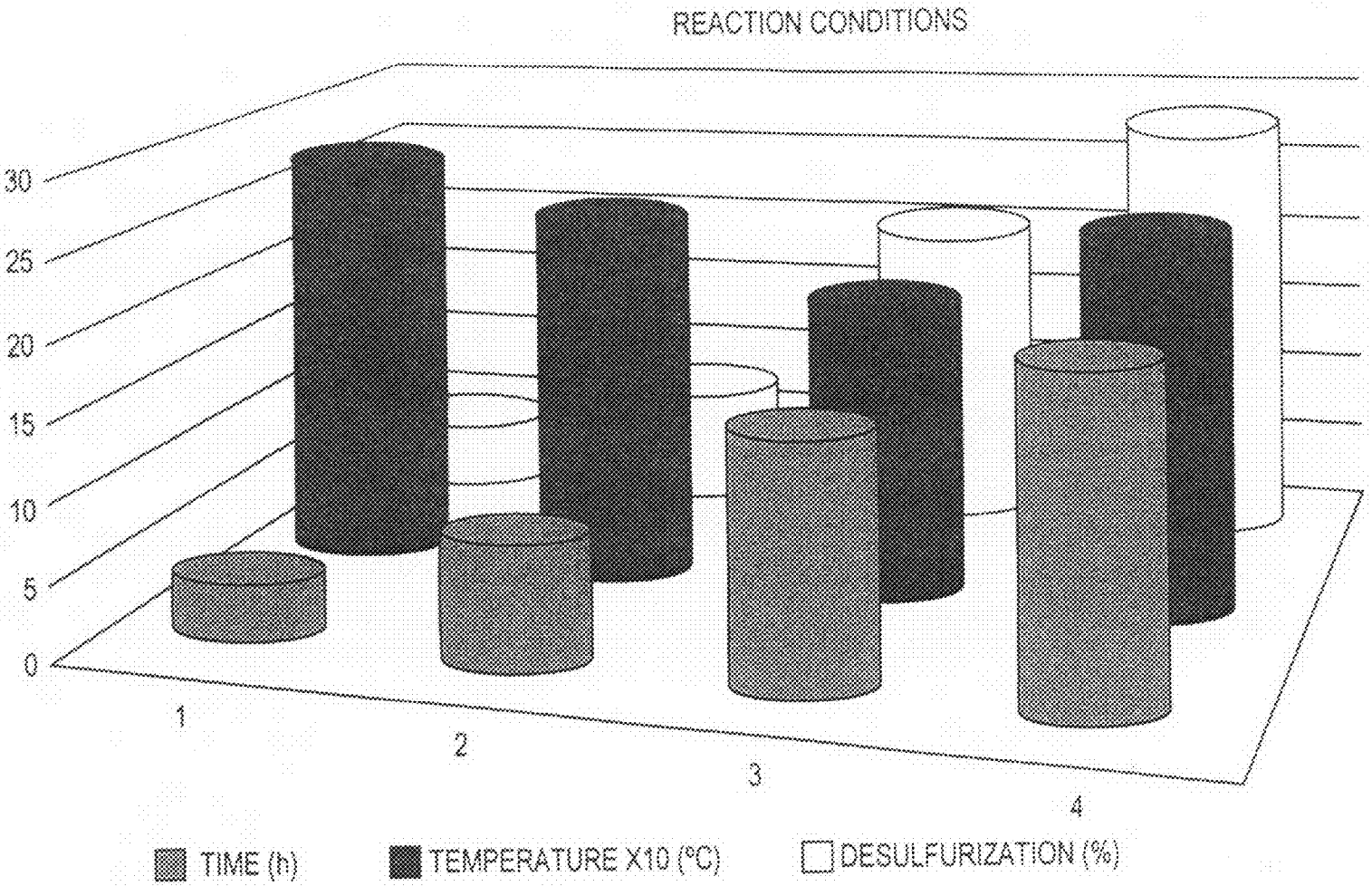
FIG. 2 is a graphical depiction of the reaction conditions and percentage of desulfurization in accordance with the present invention.

The various reaction conditions listed in Table 1 were tested and the resulting percentages of desulfurization listed in Table 1 were obtained. FIG. 2 is a graph depicting the conditions of time and temperature as well as the percentages of desulfurization achieved.

TABLE 1

| Time (h) | Temperature (° C.) | Desulfurization % |
|---|---|---|
| 4 | 280 | 5.1 |
| 8 | 250 | 8.7 |
| 16 | 200 | 21.1 |
| 21 | 250 | 28.8 |

Example 2

30 ml of diesel oil was poured into a glass-lined autoclave before adding 40 ml of sulfuric acid as the electrolyte. An external hydrogen source (hydrogen gas cylinder) was used to transfer 10 ml of $H_2$ gas into the reactor. Although the electrodes were immersed in the reaction mixture, they were disconnected from the potentiostat, i.e., there was no potential difference applied to the electrodes. The experiment was conducted at 280° C. for 24 hours, i.e., under conditions similar to those in Example 1, however, here without water electrolysis.

It was noted that there was no odor which is commonly associated with hydrogen sulfide, nor was a reduction in the sulfur concentration observed in this experiment. This test confirms that the desulfurization observed in Example 1 took place solely as the result of generating in situ reactive hydrogen species by electrocatalytic dissociation.

Thus, it can be seen that the objects set forth are achieved, and since certain changes may be made in carrying out the above process without departing from the scope of the invention, as defined by the claims that follow, it is intended that all matter in the foregoing description shall be interpreted as illustrative and not as limiting.

What is claimed is:

1. An electrocatalytic process for the removal of sulfur from organic sulfur compounds present in hydrocarbon feedstocks, which comprises the steps of:

a) adding a mixture of water and a miscible electrolyte to a non-miscible hydrocarbon feedstock containing sulfur compounds to an electrochemical reactor having a cathode and an anode said cathode and anode are metals selected from the group consisting of Groups VIIIb, Ib and IIb of the Periodic Table and their oxides, carbides, nitrides, sulfides, hydrides and mixtures thereof; and b) applying a potential difference between the cathode and the anode which acts as catalysts which causes the water to dissociate with the production of reactive hydrogen in situ which catalyzes its reaction with the sulfur-containing compounds in the hydrocarbon at the cathode surface to produce hydrogen sulfide and a treated hydrocarbon, with the proviso that the cathode and anode in the electrochemical reactor are not separated by a membrane.

2. The process of claim 1, wherein the water-to-hydrocarbon ratio is from about 0.01 to about 3.

3. The process of claim 1, wherein the electrolyte is an acid, base or a metal salt, which is miscible with the water and immiscible with the hydrocarbon.

4. The process of claim 1, wherein the applied potential difference is between about 0.1 V to about 50 V.

5. The process of claim 1, wherein the applied potential difference is between about 0.2 V to about 10 V.

6. The process of claim 1, wherein the mixture in the reactor is heated at a temperature of about 20° C. to about 400° C.

7. The process of claim 1, wherein the mixture in the reactor is heated at a temperature of about 100° to about 280° C.

8. The process of claim 1, wherein the hydrocarbon feedstock is selected from the group consisting of naphtha, diesel, vacuum residue, crude oil and mixtures thereof.

9. The process of claim 1 and including a step for the separation and recovery of the treated hydrocarbon.

10. The process of claim 1 and including a step for H2S separation and treatment.

11. The process of claim 1 and including a step of recycling the water for reuse.

12. The process of claim 1, wherein the electrical potential difference between the anode and cathode is from a nuclear or a solar source.

* * * * *